United States Patent [19]

Hayward

[11] 4,046,272

[45] Sept. 6, 1977

[54] DEVICE FOR UPENDING A CERAMIC MOLD

[76] Inventor: Donald J. Hayward, 318 S. Grove St., Delton, Mich. 49046

[21] Appl. No.: 723,237

[22] Filed: Sept. 15, 1976

[51] Int. Cl.[2] ..... B28B 21/08

[52] U.S. Cl. ..... 214/312; 214/315; 249/137; 425/218; 254/89 R

[58] Field of Search ..... 425/425, 84, 218, 435, 425/215; 249/137; 164/77; 264/302; 254/89 R; 214/313, 700, 701 R, 312, 314, 315

[56] References Cited

U.S. PATENT DOCUMENTS

| | | | |
|---|---|---|---|
| 525,103 | 8/1894 | Heidsieck | 214/313 X |
| 1,841,253 | 1/1932 | Persinger | 214/313 X |
| 2,673,009 | 3/1954 | Hawkins | 214/313 |

FOREIGN PATENT DOCUMENTS

| | | | |
|---|---|---|---|
| 496,716 | 8/1954 | Italy | 214/315 |

*Primary Examiner*—Robert D. Baldwin
*Attorney, Agent, or Firm*—Blanchard, Flynn, Thiel, Bautell & Tanus

[57] ABSTRACT

Mold dumping apparatus. Means are provided for dumping excess slip from a mold after desired wall thickness of greenware is obtained. Clamp structure is arranged on a first pair of uprights which latter are both vertically and pivotally movable on a pivot axis with respect to a second pair of uprights. Said second pair of uprights are supported rigidly on a base. The mold is received within said clamp structure and the mechanism operated to lift the first pair of uprights upwardly with respect to the second pair thereof. As same reaches a substantially predeterminable point near but above the point of the above-mentioned pivot axis, same becomes overbalanced and will automatically tip and dump the excess slip out from the mold. Any suitable receptacle may be provided for receiving said slip as it flows out of the mold.

6 Claims, 4 Drawing Figures

DEVICE FOR UPENDING A CERAMIC MOLD

FIELD OF THE INVENTION

The invention relates to pottery making equipment and particularly to apparatus for receiving a pottery-making item, such as a mold, permitting the filling thereof with slip and the subsequent dumping of excess slip therefrom by mechanical means.

BACKGROUND OF THE INVENTION

It has long been common practice to fill a ceramic mold with slip and then pouring same out leaving a film thereof coating the entire inside of the mold. Regardless of how this may be handled in large volume commercial operations, this requires for the small volume producer, or hobbyist, that the relatively heavy molds be maneuvered by hand. For the larger size of molds, this requires that a considerable weight be manipulated with the resulting inconvenience and other difficulties incident thereto. This becomes particularly critical when it is remembered that such manipulation is carried out prior to firing of the greenware and hence same is fragile and must, in spite of its weight, be handled with great care.

In spite of the existence of this problem over a long period of time, and its familiarity to all ceramic hobbyists, there has not, insofar as I am aware, been any device offered to the hobbyist or small producer for handling such molds which device is sufficiently versatile and/or adjustable to enable it to handle molds of a wide range of specific sizes and shapes, which is sufficiently reliable to handle such items without danger thereto or without the necessity of expending more than a moderate amount of personal effort by the operator thereof and which will be sufficiently inexpensive as to be acceptable to a wide market.

Accordingly, the objects of the invention include:

1. To provide a device for grasping, turning and dumping a mold which has been filled with slip.
2. To provide apparatus, as aforesaid, which can be handled with a minimum of personal effort by a small producer of pottery and/or by an individual hobbyist.
3. To provide apparatus, as aforesaid, which will be capable of grasping and handling molds under the conditions aforesaid without other than minimal danger of damage to mold and/or greenware.
4. To provide apparatus, as aforesaid, which will be adjustable through a wide range of length and width so as to accommodate molds of a wide range of sizes and shapes.
5. To provide apparatus, as aforesaid, which will be effective for the objectives above outlined but which will be of sufficiently simple construction as to be capable of original manufacture, operation and maintenance at a minimum of cost.

Other objects and purposes of the invention will be apparent to persons acquainted with apparatus of this general type upon reading the following specification and inspection of the accompanying drawings.

SUMMARY OF THE INVENTION

Figure 1:
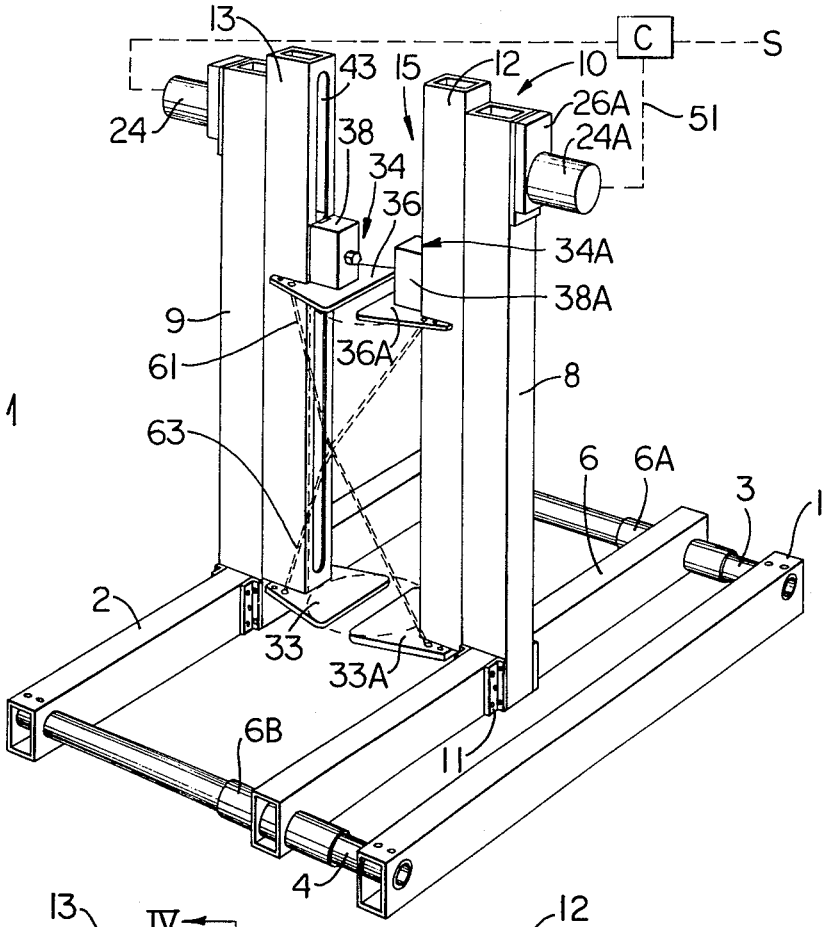
FIG. 1 is an oblique view of the apparatus of the invention with a mold indicated therein in phantom.

Summarizing the invention, same consists broadly of providing both holding, lifting and pivotal means for a mold by which when same has reached a predetermined height above a supporting surface it will automatically pivot and dump the excess slip therefrom into any suitably provided appropriate receptacle. In the specific embodiment of the invention here selected for illustrative purposes, there is provided support structure comprising a pair of upright posts firmly affixed to a base, at least one of same being made adjustable if desired to enable at least said one post to be moved toward and away from the other thereof for the purpose of accommodating molds of different sizes. Lift structure is also provided comprising a further pair of posts arranged for both vertical movement with respect to said first pair of posts and pivotal movement with respect thereto. Clamp means are arranged between the second pair of posts for firmly engaging a mold containing a liquid material such as the slip. When said second pair of posts are raised, it will correspondingly lift said mold to a point at which the center of gravity of the mass comprising the second pair of posts and the clamps and the mold is above the point at which the second pair of posts is pivoted to the first pair of posts. As said point is reached, the second pair of posts, clamps and mold affixed thereto will pivot into a dumping position. Same can be motor controlled if desired, or it can be hand operated for the purposes of economy. In either case, the movement of said center of gravity above the axis of pivoting will be carried out sufficiently slowly that the mold will pivot on said axis also slowly whereby the movement will be gentle and avoid danger of damage to the greenware.

DETAILED DESCRIPTION

Turning now to the drawings in more detail, there is provided a base structure 10 which in the embodiment here shown comprises a pair of end members 1 and 2, the same in this instance being made from rectangular tubular metal. Said end members are connected by tubing members, here round tubing 3 and 4, which are rigidly fixed, as by welding, at their respective ends to the respective end members 1 and 2. A post support 6, here comprising a tubular member essentially similar to the end members 1 and 2, is provided with bearing sleeves 6A and 6B at its respective ends which encircle and slide upon the tubular members 3 and 4. It will be noted by inspection of the drawings that said bearing members are placed slightly below center of the post support 6 whereas the tubular members 3 and 4 are placed slightly above center of the end members 1 and 2. Thus, it is provided that the post support member 6 is positioned slightly above a surface supporting said end members whereby to slide readily without interference from such surface.

Post 8 is rigidly fixed to the post support 6 by any convenient means, here by angle irons of which one is shown at 11 which may be fixed, as by welding, screwing or otherwise, to appropriate portions of said post and the post support. Post 9 is likewise rigidly fixed to end member 2.

Figure 3:
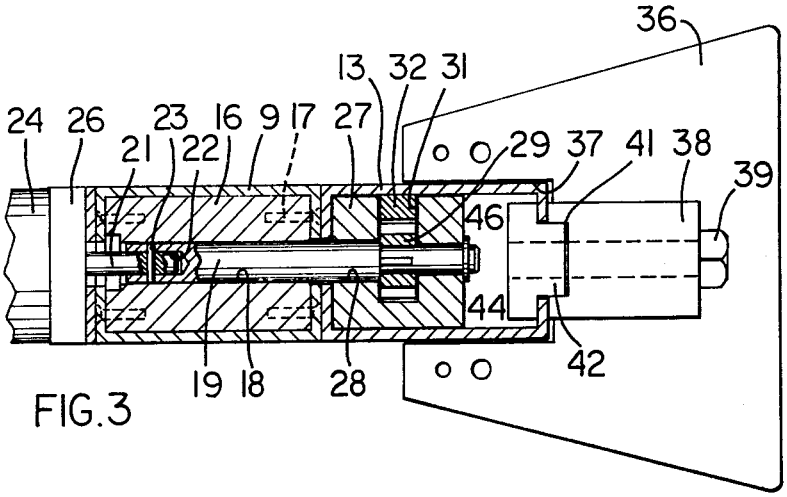
FIG. 3 is a section taken on the line III—III of FIG. 2.

Turning now to the lift mechanism 15, a pair of clamp posts 12 and 13, preferably of rectangular tubular material generally similar to that of the support posts 8 and 9, are arranged snugly adjacent the respectively facing surfaces of said support posts 8 and 9 and are arranged for both vertical movement with respect thereto and pivotal movement with respect thereto. While in a broad sense same may be accomplished in any of many specific ways, in the narrower sense the invention includes the provision within the support post 9 of a bearing block 16 which may be fixed thereto in any convenient manner such as by machine screws of which one is indicated at 17 (FIG. 3). An opening 18 extends through said block transversely of the support post 9 for the reception of a shaft 19. The surface of said opening 18 functions also as a bearing surface for the shaft 19. Suitable means are provided as desired for effecting controlled rotation of the shaft 19. In this instance a drive shaft 21 is received into a suitable opening 22 in an end of the shaft 19 and is pinned for rotation therewith by a pin indicated at 23. Means are provided as desired for effecting rotation of the drive shaft 19. In the present instance such means comprise a motor 24, preferably a slow-speed motor, and connecting gear mechanism of any conventional type contained within the housing 26. Same may, however, if desired be replaced by a crank or other drive means according to the economics of the particular apparatus in question.

Figure 2:
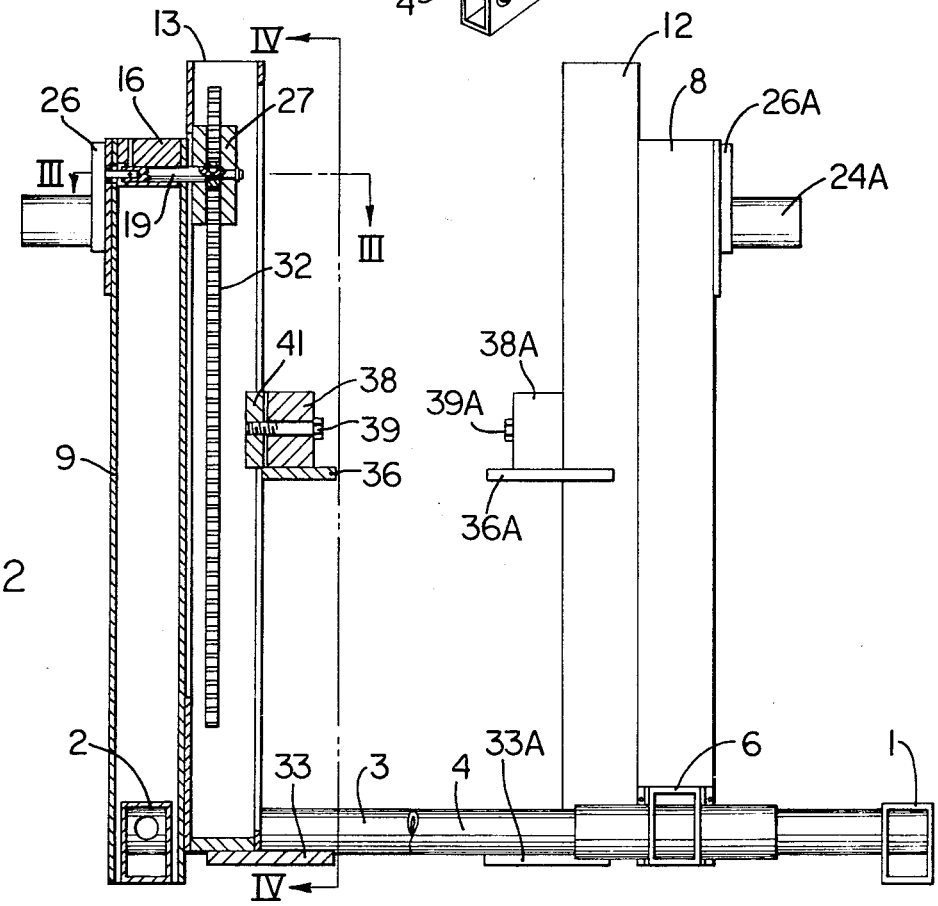
FIG. 2 is a side view of the apparatus shown in FIG. 1 with the lefthand portion thereof shown in central section.

Adjacent the upper end of the lifting post 13 there is inserted a guide block 27 (FIG. 2) which is slidably related to said lifting post. Same is retained by the three adjacent walls of the lifting post together with the hereinafter mentioned rack 32. An opening 28 is provided through the lifting block 27 to receive an appropriate projection of the shaft 19. A pinion 29 is provided on said projection of the shaft 19 and is arranged for rotation therewith.

The lifting block 27 is provided with a slot 31 for the reception of said pinion 29. A rack 32 is fixed to the side of the lifting post 13 in any convenient manner, such as machine screws similar to the machine screws 17, and is positioned for engagement with the pinion 29. Thus, rotation of the shaft 19 will rotate said pinion 29 which acts against the rack 32 for effecting vertical movement of said rack, and consequently of the lifting post 13, with respect to the support post 9. However, it will be further recognized that the lifting post 13 will be free to pivot around the axis of the shaft 19 with respect to the support post 9.

Turning now to the clamp structure, there is provided a lower clamp plate 33 fixed to the bottom of the lifting post 13 in any convenient manner, such as by welding. An upper clamp member 34 here constitutes plate 36 having an opening 37 (FIG. 3) therein which embraces a portion of the lifting post 13. A clamp block 38 is fixed rigidly to said plate 36 and carries a screw 39 extending therethrough for engagement with the further block 41. Said block 41 has a projecting portion 42 extending through a slot 43 which latter extends all or most of the full length of the lifting post 13. Thus, said upper clamp 34 may be raised or lowered as desired and by tightening the screw 39 the blocks 38 and 41 will be drawn together to clamp same against the flanges 44 and 46 defining said slot 43 and thereby holding the upper clamp 34 firmly in position.

The supporting post 8 and lifting post 12 are similarly provided with lifting mechanism in the same manner, although in mirror image thereto, as that already described with respect to the support post 9 and lifting post 13 and no detailed description thereof is needed. For identification purposes, however, those parts which have already been described in connection with support post 9 and lifting post 13 and which are visible in the drawings in connection with support post 8 and lifting post 12 are indicated in the drawings by the same numerals as used in connection with the posts 9 and 13 with the letter A added.

It will be apparent that any convenient means, not shown, may be provided as desired for energizing and simultaneously controlling the rotation of the drive motors 24 and 24A. For example, said drive motors may be synchronous motors which will rotate at the same speeds from a single control. Such control means, however, are well known to the art and need no separate or detailed description. Such is indicated schematically by the broken lines 51 and 52 indicating lines by which said motors 24 and 24A are energized from a source S through switching and control means C.

OPERATION

The operation of the mechanism is relatively simple and will be easily understood.

A mold to be filled with a liquid material, such as slip, will be placed on the lower clamp plates 33 and 33A with the support posts 8 and 9 being positioned an appropriate distance apart to position the lifting posts 12 and 13 properly to enable said mold to be received closely therebetween. The upper clamp structures 34 and 34A are then vertically adjusted to rest snugly against the upper end of the mold by appropriately loosening the screws 39 and 39A, adjusting said clamp means as desired and then retightening said screws for fixing said clamps firmly in position. If desired, additional means may be provided for holding said mold in position, such as by elongated members, preferably resilient, such as shock cord, extending between the upper and lower clamp plates in any desired manner to hold the mold firmly in position. For example, the shock cord indicated at 61 may extend from the upper clamp plate 36 to the lower clamp plate 33A and a further shock cord 62 may extend from the upper cord 36A to the lower clamp plate 33. Similar shock cord may then be provided in a similar manner on the opposite side of said clamps for holding the mold firmly therebetween. If the mold has not already been filled with slip material, such filling should now occur.

The motors 24 and 24A are then actuated by appropriate manipulation of the control C (or if cranks are used in place of said motors, same may be manually rotated simultaneously and at the same rate) so that the shaft 19 and its counterpart within the posts 8 and 12 are caused to rotate simultaneously, synchronously and controllably. This rotates the pinion 29 and its counterpart on the other side of the apparatus to drive the rack 32 and with it the lifting post 13 upwardly. Lifting post 12 is similarly and simultaneously raised at the same rate for reasons which will be obvious from the preceding description.

Figure 4:
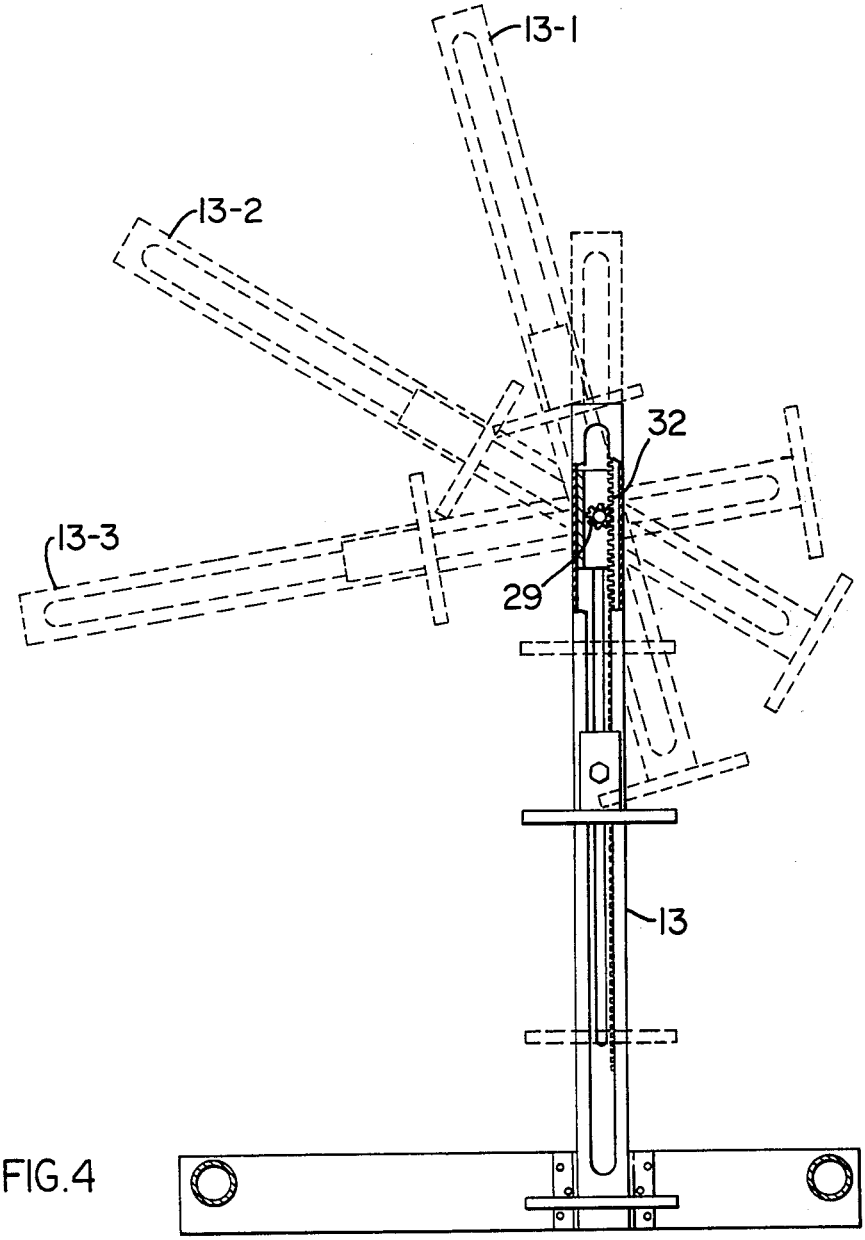
FIG. 4 is a section taken on the line IV—IV of FIG. 2 with the positions progressively occupied by one of the parts shown in phantom to illustrate the operation of the equipment.

So long as the center of gravity of the system including the lifting posts 12 and 13 together with the clamp members and mold fixed thereto remains below the axis of the shaft 19 and its counterpart on the other side of the apparatus, the device will remain in the position shown in FIG. 1. However, as soon as said center of gravity rises above such axis, the structure including the lifting posts 12 and 13 and means affixed thereto will start to tilt as illustrated at 13-1 in FIG. 4. So long as said center of gravity is lifted only a short distance, and slowly, above the axis of said shafts, such tilting will occur slowly. Continued tilting thereof may then either be accomplished by hand, if desired, or the operator may wait for said lifted center of gravity to accomplish its work of completely inverting the mold. It will normally be preferably, however, to continue lifting the lifting posts 12 and 13 and means associated therewith in order to effect mechanically, but at an acceptable rate of speed, the continued pivoting of said lifting structure through the positions 13-2 and 13-3 which latter becomes a position for dumping of slip from the mold held thereby.

After dumping is completed, the driving means 24 and 24A may be reversed and the lifting structure returned downwardly. As soon as the center of gravity returns to a position below that of the axis of shaft 19 and its counterpart on the other side of the device, the lifting structure will resume the position shown for same in FIG. 1 and by the time the lifting structure has returned to its lowermost position as shown in FIG. 1 the mold will have returned to the centered position shown in FIG. 1 and may be removed in a simple manner by releasing both of the movable clamps 34 and 34A together with releasing of whatever means, such as the shock cords 61 and 63, have been utilized for holding the mold in position between the clamp plates. Said mold may then be removed for further processing as desired and the apparatus is ready for similar handling of a successive mold.

Although a particular preferred embodiment of the invention has been disclosed in detail for illustrative purposes, it will be recognized that variations or modifications of the disclosed apparatus, including the rearrangement of part, lie within the scope of the present invention.

I claim:

1. In a device for dumping a liquid from a mold, such as for dumping slip from a mold, the combination comprising:

support structure comprising a base and a pair of upstanding support posts positioned rigidly thereon;

lift structure comprising a pair of parallel arranged lifting posts connected in vertically movable, and pivotal, relationship with said support posts and including clamp means for holding a mold on and between said lifting posts;

operator controllable means for lifting said lifting posts with respect to said support posts, and pivot means fixedly mounted on said support posts constantly maintaining said pivotal relationship between said lifting posts and support posts;

whereby so long as the center of gravity of said support posts and the means associated therewith is below the pivotal axis of said pivot means a mold held within said clamp means will remain in liquid holding position but upon lifting of said support structure above said axis such mold will be automatically dumped.

2. The device of claim 1 wherein at least one of said support posts is movable on said base toward and away from the other of said support posts for adjusting the spacing between said lifting posts.

3. The device of claim 1 wherein at least one portion of the clamp means arranged on said lifting posts is vertically movable with respect to other portions of said clamping means for adjusting same to molds of varying sizes.

4. The device of claim 1 wherein the clamp means comprise upper and lower clamp plates and including also resilient elongated means extending between said clamp plates for holding a mold in position between said clamp plates in all vertical and tilted positions occupied by same during said dumping procedure.

5. The device of claim 1 wherein the sole connection between said lifting posts and their respectively associated support posts each comprises coaxially positioned shafts which are associated with lifting means between said support posts and said lifting posts but which permit tilting of said lifting structure with respect to said support structure at any relative vertical position therebetween whereas the center of gravity of the lifting structure and any load carried thereby rises above the common axis of said shafts.

6. The device of claim 5 including also a block rigidly fixed into each of said support posts for the rotative reception and bearing support of said respective shafts and a guide block slidably provided in each of said lifting posts for the reception and guidance of the other ends of each of said respective shafts;

a rack arranged along each of said lifting posts and fixed rigidly thereto and a pinion on each of said shafts engageable with each of said racks;

whereby rotation of said shafts will act through said pinions and racks to effect vertical movement of said lifting structure with respect to said support structure and permit tilting movement of said lifting structure with respect to said support structure when the center of gravity of the lifting structure and load means carried thereby rises above the common axis of said shafts.

* * * * *